United States Patent [19]

Cohen

[11] 4,191,439

[45] Mar. 4, 1980

[54] DRAWER CONSTRUCTION

[75] Inventor: Arik Cohen, Jerusalem, Israel

[73] Assignee: Rim Jerusalem Furniture Limited, Jerusalem, Israel

[21] Appl. No.: 911,196

[22] Filed: May 31, 1978

[30] Foreign Application Priority Data

Jun. 1, 1977 [GB] United Kingdom ..... 23307/77
Nov. 25, 1977 [GB] United Kingdom ..... 49267/77

[51] Int. Cl.[2] ..... A47B 88/02; A47B 47/04

[52] U.S. Cl. ..... 312/330 R; 312/111; 312/263; 403/231

[58] Field of Search ..... 312/330, 257 R, 257 SK, 312/257 SM, 263, 111; 403/187, 237, 235, 231, 403, 205; 217/12; 220/4 F

[56] References Cited

U.S. PATENT DOCUMENTS

| | | | |
|---|---|---|---|
| 3,429,631 | 2/1969 | Neyroud | 312/257 R |
| 3,846,003 | 11/1974 | Rockwell | 312/330 |
| 3,876,270 | 4/1975 | White | 312/257 R |
| 3,989,157 | 11/1976 | Veenema | 217/12 R |
| 4,036,542 | 7/1977 | Courtwright | 312/263 |

FOREIGN PATENT DOCUMENTS

| | | | |
|---|---|---|---|
| 2312215 | 12/1976 | France | 312/330 |
| 223272 | 9/1942 | Switzerland | 403/205 |

*Primary Examiner*—Alexander Grosz
*Attorney, Agent, or Firm*—Kurt Kelman

[57] ABSTRACT

A knock down drawer construction is disclosed in which metal or plastics brackets take the place of conventional dovetail joints. In preferred forms of the invention the front of the drawer is connected to each side of the drawer by a respective channel section bracket the base of which is screwed to the rear face of the drawer front while the end of the drawer side is received in the channel. In these preferred forms, the drawer sides are connected to the drawer back by brackets each providing two channels one receiving the end of the drawer back and the other receiving the rear end of the drawer side.

14 Claims, 18 Drawing Figures

DRAWER CONSTRUCTION

Figure 1:
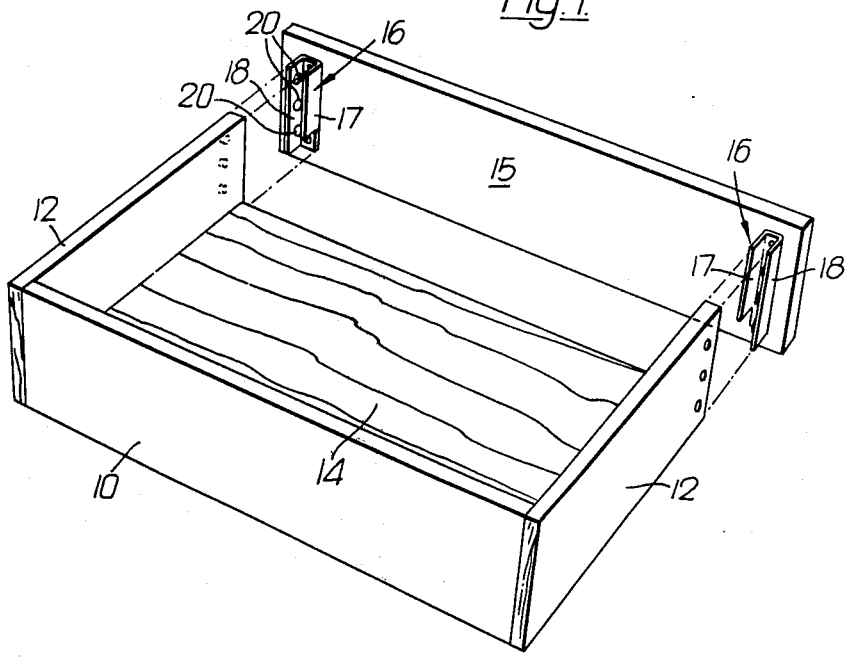

This invention relates to drawers.

Traditionally, drawers in articles of furniture comprise a rectangular frame formed of four wooden boards or planks and comprising a back formed by one such board lying in a vertical plane, sides formed by respective boards secured to the back and extending in parallel vertical planes perpendicular to that of the back and a front formed by a board extending in a vertical plane parallel with that of the back and secured to the ends, remote from the back, of the boards which form the sides. The bottom of the drawer commonly comprises a thin wooden panel located at its side edges in longitudinal grooves provided on the inner faces of the boards forming the sides of the drawer. In a traditional drawer construction, the sides of the drawer are connected to the front, and frequently also to the back, by dovetail joints so formed as to be invisible from the front of the drawer. However, such joints are expensive to make, even by machine, and such joints, although fairly satisfactory when made in wood are less satisfactory when made in other furniture making materials now commonly used, such as chipboard.

Furthermore, the traditional drawer construction using dovetail joints does not lend itself readily to drawers for furniture of the so-called 'knock-down' type, which drawers must themselves be of 'knock-down' construction. The term 'knock-down' as applied to an article of furniture means that the article comprises a plurality of prefabricated parts which are supplied to the customer, e.g. in kit form, unconnected to each other but which can readily be assembled by the customer, with only very simple tools and with only ordinary skill, to produce the finished article of furniture.

It is an object of one aspect of the present invention to provide a drawer construction which is strong, inexpensive and easily effected and which is particularly suitable for a 'knock-down' drawer.

Accordng to one aspect of the invention there is provided a drawer construction comprising a front member, a back member, two side members, all of said members having parallel major faces on opposite sides thereof, the drawer construction further comprising a bottom and a plurality of brackets, each said bracket having a wall part parallel with and engaged by one said face of one of said side members and having a perpendicular wall part parallel with and engaged by one of said major faces of one of the other members.

Preferably at least one said bracket includes a pair of parallel transversely spaced side walls, a base wall connecting said side walls and defining with said pair of side walls a respective channel receiving an end of one of said members, said side walls engaging opposite said major faces of said member received in said channel.

According to another aspect of the invention there is provided a kit including parts from which a drawer can be constructed, said kit including a drawer front, a drawer back, drawer sides and brackets whereby said drawer front and/or back can be connected with said drawer sides, said two side walls each having one end at least thereof formed for engagement with a respective one of said brackets, the arrangement being such that each said side wall can be fitted, at said one end thereof, into a respective said bracket simply by relative linear movement of the side wall with respect to the drawer front.

According to yet another aspect of the invention there is provided a bracket for use in a drawer construction and comprising a first part for engagement with a first drawer member and a channel adapted to receive an end of a second drawer member extending perpendicular to the first drawer member.

Figure 2:
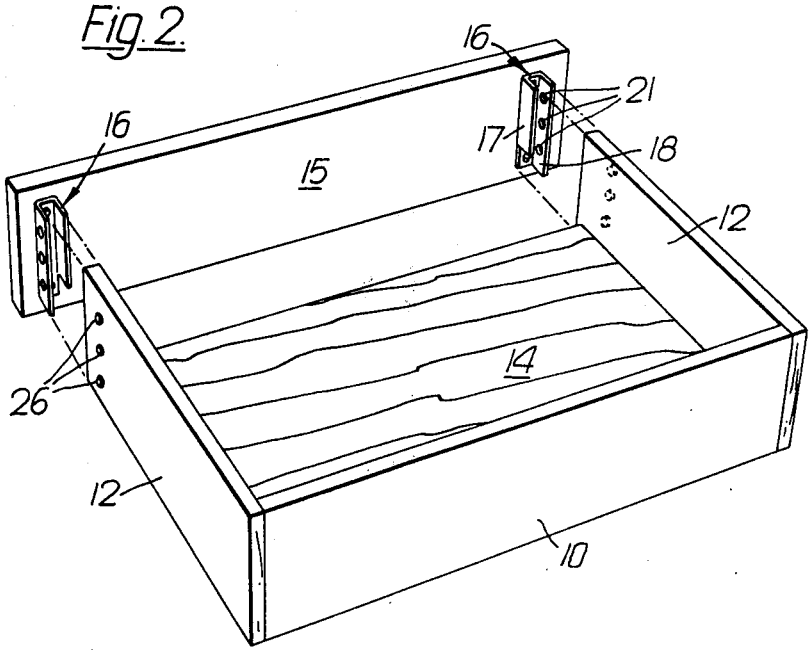
Figure 3:
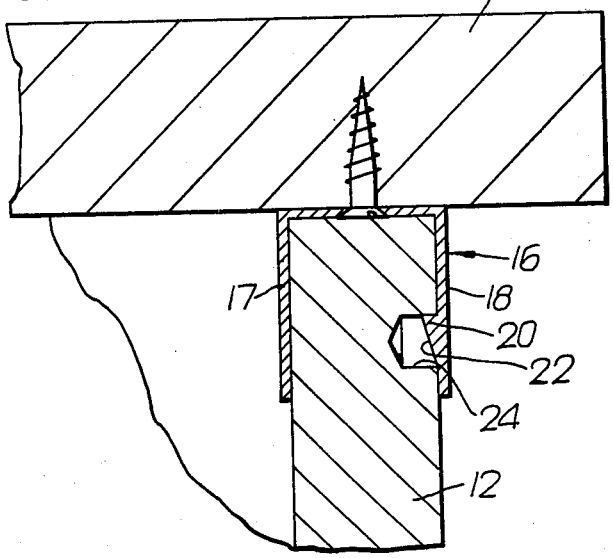
Figure 4:
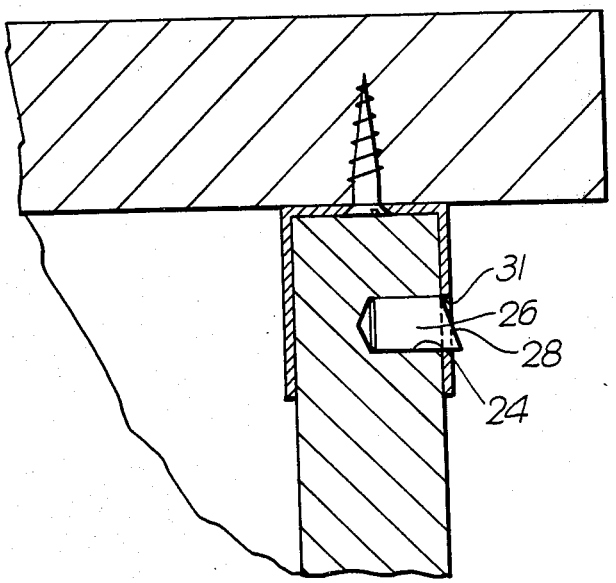
Figure 5:
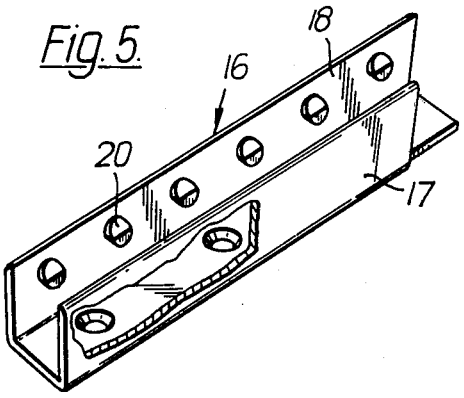
Figure 7:
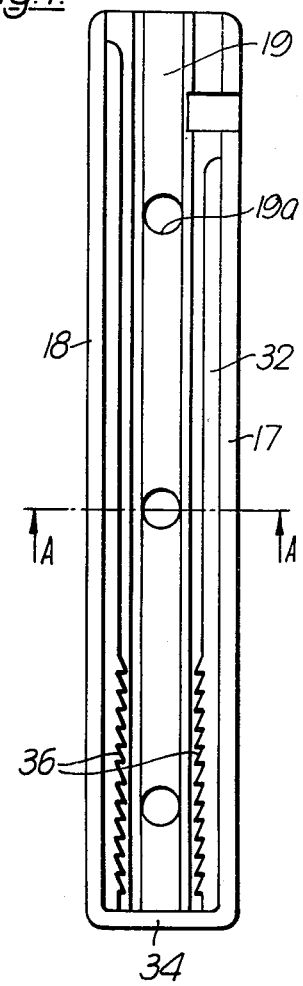
Figure 6:
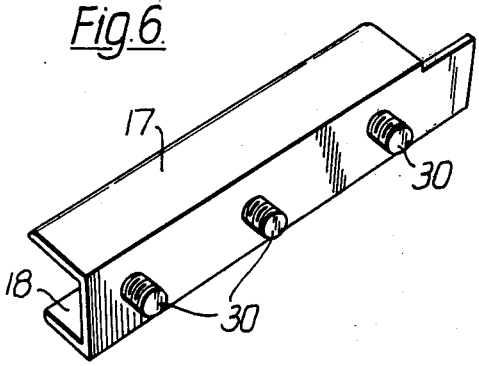
Figure 8:
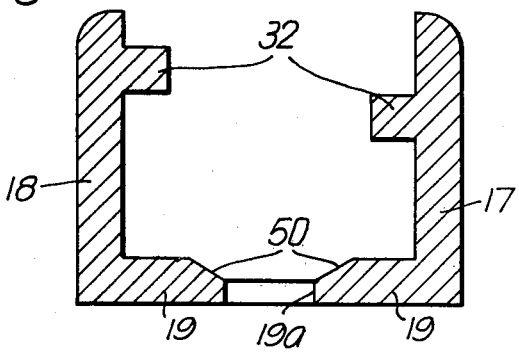
Figure 9:
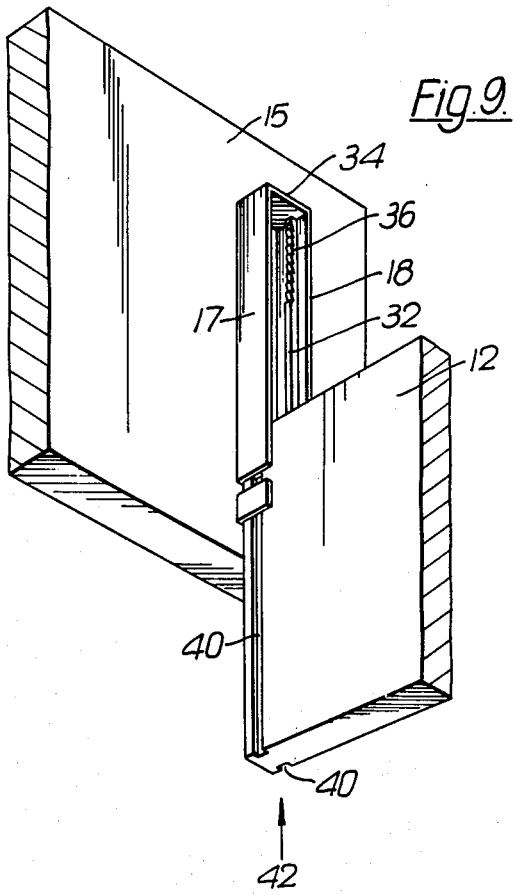
Figure 10:
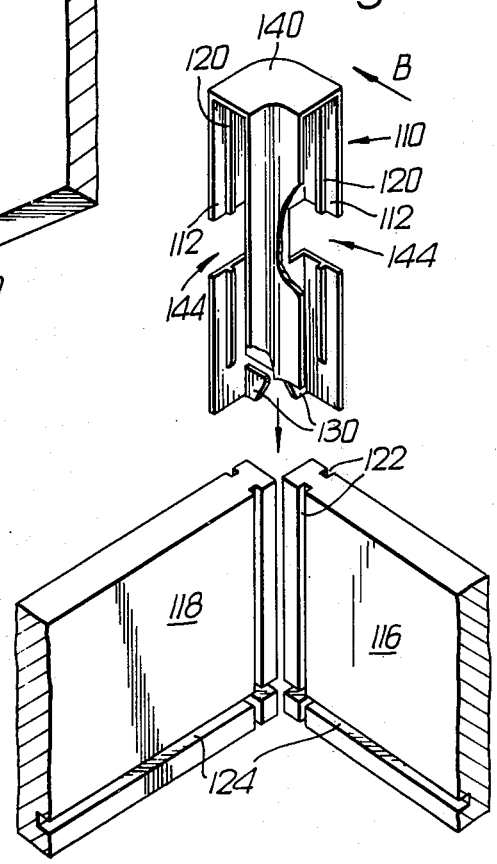
Figure 11:
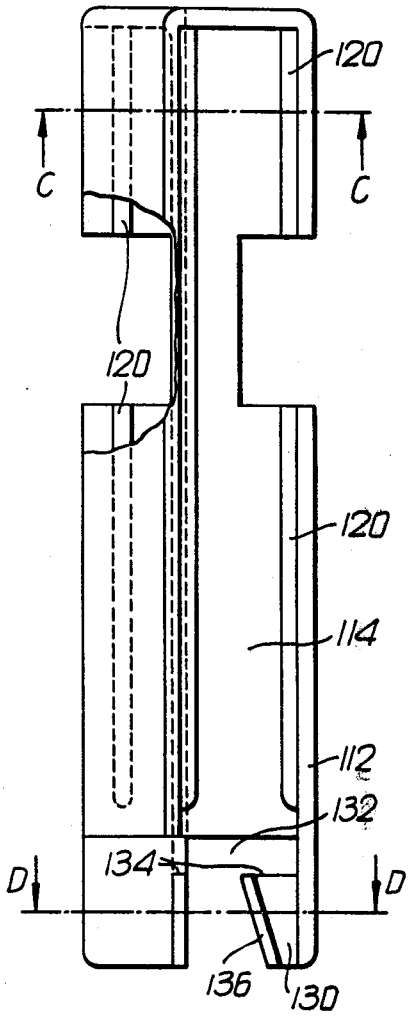
Figure 12:
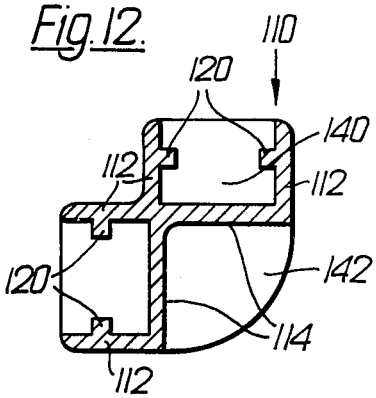
Figure 13:
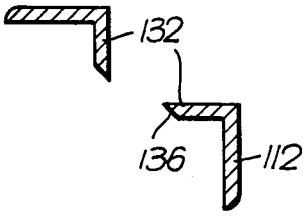
Figure 14:
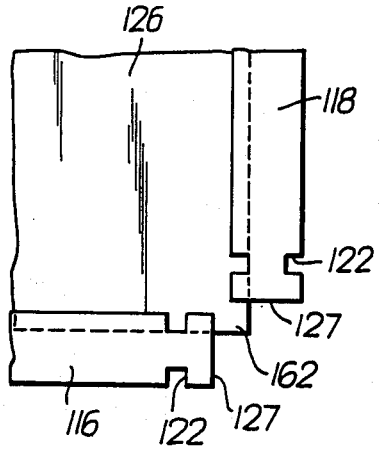
Figure 15:
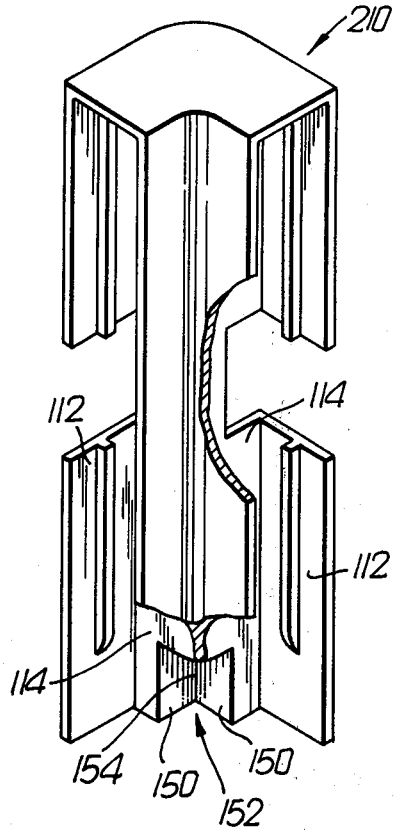
Figure 17:
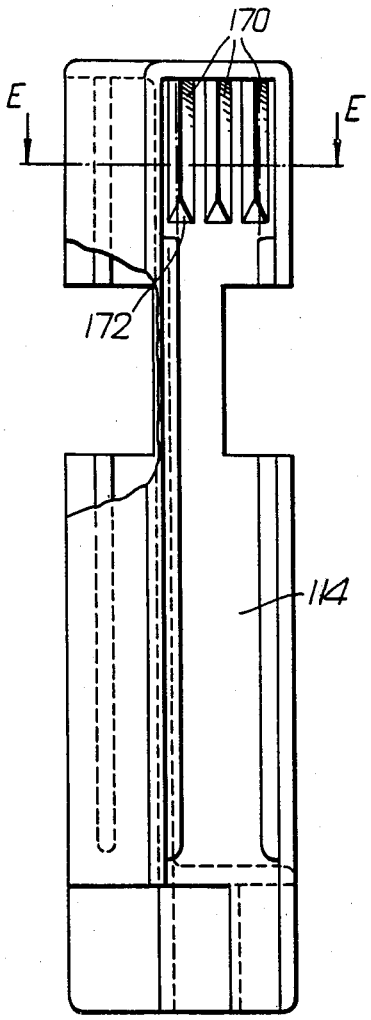
Figure 16:
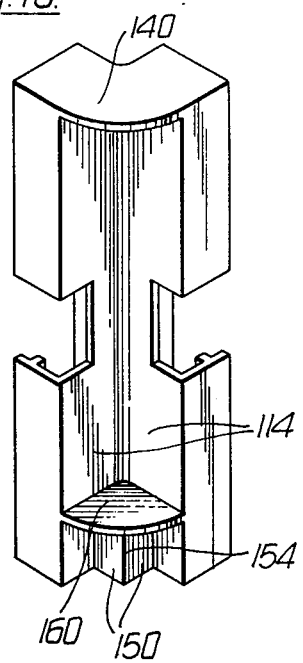
Figure 18:
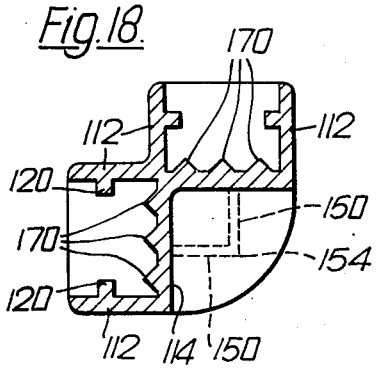

Embodiments of the invention are described below with reference to the accompanying drawings wherein:

FIG. 1 is a partly exploded perspective view of one form of drawer construction embodying the invention, FIG. 2 is a partly exploded perspective view of another form of drawer construction embodying the invention, FIG. 3 is a view, in horizontal section and to a larger scale, of a detail of the drawer of FIG. 1, FIG. 4 is a view, in horizontal section and to a larger scale, of a detail of the drawer of FIG. 2, FIG. 5 is a perspective view, partly broken away, of a variant of the bracket used in the drawer construction of FIGS. 1 and 3, FIG. 6 is a perspective view, from a different angle as compared with FIG. 5, of another variant of the bracket used in the drawer construction of FIGS. 1 and 3, FIG. 7 is an elevation view of yet another variant of a bracket incorporating the invention, FIG. 8 is a view in cross-section on the line A—A of FIG. 7, FIG. 9 is a fragmentary perspective view showing the assembly of a drawer incorporating the bracket of FIGS. 7 and 8, FIG. 10 is a perspective view showing the manner of fitting a yet further form of bracket to a drawer back and drawer side, the bracket being partially broken away for purposes of illustration, FIG. 11 is a side elevation view of the bracket looking in the direction of the arrow B in FIG. 10, FIG. 12 is a view in horizontal section on line C—C of FIG. 2, FIG. 13 is a view in horizontal section along the line D—D in FIG. 2, FIG. 14 is a fragmentary plan view of a rear corner of a drawer before the bracket of FIGS. 10 to 13 is fitted, FIG. 15 is a perspective view from the same viewpoint as in FIG. 10, of a variant of the bracket of FIG. 10, the bracket being partially broken away for purposes of illustration, FIG. 16 is a perspective view from the opposite side of the bracket of FIG. 15, FIG. 17 is a side elevation view, corresponding to FIG. 11, of the bracket of FIGS. 15 and 16, and FIG. 18 is a view in section on line E—E of FIG. 17.

Referring to FIGS. 1 and 3 of the drawings, a drawer, shown in FIG. 1 with the front detached, comprises a back 10, sides 12 secured at their ends to the back, the front, indicated at 15 and a bottom 14, for example of plywood, having its side edges received in the traditional manner in longitudinal grooves, not shown, provided along the inner faces of the sides of the drawer and spaced above the bottom edges of the drawer sides. The front 15 of the drawer has secured to its rear face two metal brackets 16 of rectangular channel section, each bracket being so disposed that the base of the channel lies against the rear face of the drawer front with the longitudinal axis of the channel extending vertically and the walls 17, 18 of the channel extending rearwardly from the base of the channel. Each bracket 16 is secured to the drawer front by two countersunk screws passing through apertures in the base of the respective channel adjacent the upper and lower ends of the bracket. The drawer front is fitted to the rest of the drawer, for example after the sides 12 have been fixed to the back 10 and the bottom 14 fitted, simply by pushing the front on to the remainder of the drawer construction so that the front end part of each side 12 enters the channel of the respective bracket 16, until the front edge face of each side 12 engages the base of the respective channel, each side 12 fitting snugly in the channel of its respective bracket 16, with its side faces engaging the inner faces of the walls of the respective channel, as shown in FIG. 3, a fragmentary view in horizontal section. The inner wall 17 of each bracket 16 is cut away adjacent the lower end of the bracket, as shown in FIG. 1, to clear the front edge of the bottom 14. The features described so far are also features of the drawer construction shown in FIGS. 2 and 4. In both drawer constructions locating means is provided preventing withdrawal of the sides 12 rearwardly with respect to the drawer front 15 from the fully inserted position shown in FIG. 3 or FIG. 4 and also preventing sliding of the front ends of the sides 12 from the brackets 16 in the vertical direction.

In the construction shown in FIGS. 1 and 3, the locating means comprises projections 20 projecting inwardly from the outer wall 18 of the bracket, each projection being substantially circular as viewed in a direction perpendicular to the plane of the wall 18 and having an end face 22 which, as shown in FIG. 3, slopes inwardly towards the inner wall 17 of the channel in the direction towards the base of the channel. Each said projection engages in a respective bore 24 extending into the respective side 12 from the outer face thereof. In assembly of the drawer of FIGS. 1 and 3, the bottom 14, back wall 10 and side walls 12 are first assembled, then the drawer front 15, with the brackets 16 already secured thereto, is pushed into engagement with the rest of the drawer so that the ends of the sides 12 are received in the brackets 16. The material of the brackets 16, in the embodiment of FIGS. 1 and 3 is sufficiently resilient to allow the walls 17, 18 of each bracket to spring apart sufficiently, during insertion of the respective side 12, to allow the sloping face of the projections 20 to ride over the end of the side 12 and over the outer surface thereof until, when the side 12 is fully inserted, the projections 20 snap into their respective bores 24. The projections 20 thus act as barbs, preventing subsequent withdrawal of the sides 12 from the brackets.

The projections 20 may, if preferred, be formed by pressed out portions of the side wall 12, and in this case each projection may, if desired, be severed, around part of its perimeter, from the surrounding metal of the side wall 18 so that the projection itself is resiliently deformable to some extent with respect to the side wall 18 as a whole.

The construction shown in FIGS. 2 and 4 differs from that shown in FIGS. 1 and 3 in that in the construction of FIGS. 2 and 4, the projections 20 are replaced by circular holes 21 in the wall 18 of each bracket, and the bores 24 in the sides 12 are somewhat deeper and accommodate respective cylindrical plugs 26 each of which has a flat end face 28, facing outwardly from the respective side 12 and which slopes from a level substantially coincident with that of the outer face of the side 12 at its point nearest the front 15, to a level spaced substantially outwardly from the last mentioned face at its point furthest from the front 15. Once again the brackets 16 are sufficiently resilient to allow the wall 18 to flex outwardly from the wall 17 as the wall 18 rides over the sloping face 28 during insertion of the respective side into the respective bracket, until, when the side is fully inserted in the bracket, the holes 21 reach alignment with their respective plugs allowing the wall 18 to snap back with the projecting parts of the plugs extending through the respective holes, subsequent withdrawal of the side 12 being prevented by abutment of the edges of the holes with the projecting cylindrical surfaces of the holes. The drawer of FIGS. 2 and 4 is assembled in the same way as the drawer of FIGS. 1 and 3.

In the description which follows with reference to FIGS. 5 to 9, parts which correspond to parts in FIGS. 1 to 4 have the same reference numerals.

Whilst in the description with reference to FIGS. 1 and 3, the brackets 16 have been described as being of metal, the brackets may alternatively be moulded in a suitable plastics, such as nylon. FIG. 5 shows a bracket 16 similar to the bracket 16 of FIGS. 1 and 3 but moulded in plastics, part of the side wall 17 being broken away to show the countersunk holes in the base part of the bracket intended to receive fixing screws. In the bracket of FIG. 5, the projections 20 have the form of cylindrical studs each having its end formed by two planar faces one of which, on one side of a diameter extending in the longitudinal direction of the bracket, being the side nearer the base of the channel section bracket, is parallel with the side wall 18, and the other of which planar faces is a sloping ramp face which extends from the junction with said one planar face, at said diameter, to the internal surface of the wall 18. FIG. 6 shows a variant bracket, also moulded in plastics, and which differs from the bracket of FIG. 5 in that in place of holes for fixing screws, integral stubs or dowels 30 project from the base of the bracket in a direction opposite from that in which the side walls 17, 18 extend. Thus the bracket of FIG. 6 can be secured to a drawer front simply by drilling appropriately dimensioned and located blind bores in the drawer front from the rear face thereof and pressing each bracket against the rear face of the drawer front at the appropriate position so that the dowels 30 enter their respective blind bores and are held therein by frictional engagement. In order to improve the frictional engagement of the dowels 30 in these blind bores, the dowels may be externally barbed or corrugated circumferentially so that the corrugations have a sawtooth form in axial section through the dowels.

FIGS. 7 and 8 illustrate yet another form of bracket which may be moulded in plastics material, this bracket also being generally of channel section and comprising a base 19 provided with holes **19*a* to receive fixing screws and having side walls 17, 18 extending from respective longitudinal edges of the base 19. FIG. 7 shows the bracket in elevation viewed in a direction perpendicular to the plane of the base, corresponding to a view from the rear of a drawer front (not shown) to which the bracket is secured. FIG. 8 is a view of the bracket in section along the line A—A of FIG. 7. As with the constructions described previously, in the assembled drawer the base 19 engages the rear face of the drawer front and the side walls 17, 18 engage opposite faces of the respective side wall of the drawer. As is also the case with the previously described embodiments, the respective end part of a side wall 12 of a drawer is readily inserted in the bracket and is thereafter retained against removal from the bracket. However, whereas in the embodiment of FIGS. 1 to 6, the end part of each side wall 12 of the drawer is inserted in the respective bracket 16 in a direction perpendicular to the plane of the drawer front 15, in assembling a drawer utilising the bracket of FIGS. 7 and 8, the respective end part of each side wall 12 of the drawer is inserted in the respective bracket secured to the drawer front 15 by sliding the side wall 12** into the bracket in a direction parallel with the planes of the drawer front and the drawer side wall.

It will be noted from FIGS. 7 and 8 that the bracket shown therein has, on the inner side of each of its side walls 17, 18 at a respective position spaced somewhat from the base of the channel, a respective inwardly projecting rib 32, substantially rectangular in cross-section, the ribs 32 being at equal distances from the base of the channel. As shown in FIG. 7, one end of the channel is closed by an end wall 34 and the portions of the ribs 32 lying within a predetermined distance of this end wall 34 are provided with sawteeth or serrations 36, in the form of inclined barbs directed towards said end wall 34. The longitudinal ends of the ribs 32 remote from the end wall 34 are rounded to facilitate insertion of a drawer side wall 12.

As shown in FIG. 9, the drawer side wall 12 to be fitted in the bracket of FIGS. 7 and 8 has on either side a respective groove 40 extending from the upper to the lower edge of the side wall in a direction parallel with the end face of the side wall, the dimensions of the grooves 40 and the spacing thereof from the adjacent end face of the side wall being such that when the side wall is slid into the bracket in the direction of the arrow 42 (FIG. 9) i.e. a direction parallel with the longitudinal directions of the ribs 32 and grooves 40, the ribs 32 engage in the grooves 40 and bear resiliently against the bottoms of the grooves 40, the tips of the teeth bearing against the bottoms of the grooves 40 once the side wall 12 has been pushed fully home into the channel provided by the bracket so that one of the narrower longitudinal faces of the drawer side wall 12 bears against the end wall 34. The barb-like teeth 36 thereafter prevent withdrawal of the drawer side wall from the channel in a direction opposite to that of the arrow 42.

As already indicated, the bracket of FIGS. 7 to 9 may be secured to the rear face of a drawer front by screws passed through the holes **19*a* provided in the base 19 of the bracket, in the same way as described with reference to the brackets of the embodiments of FIGS. 1 to 5. However, a bracket otherwise identical with the bracket of FIGS. 7 and 8 may be provided with integral dowels in place of holes for fixing screws, in the same was as described with reference to FIG. 6, the bracket being secured to a drawer front in the same way as the bracket of FIG. 6**.

Whereas FIG. 8 shows the ribs 32 as being offset with respect to each other, so that the spacing of the rib 32 on the side wall 18 from the base 19 is greater than that of the rib 32 on the side wall 17, the ribs 32 may, if preferred be disposed both at the same distance from the base 19. While this would simplify manufacture to some extent, the necessity of placing the corresponding grooves 40 directly opposite one another on the drawer side would tend to weaken the end part of the drawer side more than the arrangement shown.

It will be noted that in FIG. 7 the slot formed in wall 17 adjacent its end remote from end wall 34, in order to receive the edge part of the drawer bottom, is also extended partly across the base 19, so that theform of the front edge of the drawer bottom can be simplified and rebates need not be formed at the front corners of the drawer bottom.

Whilst in the bracket of FIGS. 7 and 8, the holes **19*a* could be individually countersunk, as in the bracket of FIG. 5, it is preferred, as shown, that the holes 19*a* are formed in the bottom of a shallow longitudinal channel formed along the base 19 on the interior of the bracket, the sloping side walls 50 of the channel corresponding to the surface of the countersunk portion of each bore in the base of the channel in the embodiments of FIGS. 1 to 5**. This feature simplifies moulding of the bracket.

Referring to FIG. 12, the bracket, indicated generally at 110, substantially comprises two generally rectangular channel-section members, extending longitudinally in the vertical direction (perpendicular to the plane of FIG. 12) and joined to one another along respective zones where a side wall and the base wall of the respective channel meet. Thus, the side walls 112 of one channel lie generally in parallel planes parallel with the base wall 114 of the other channel and thus perpendicular with the planes of the side walls of the other channel. As shown in FIG. 10, a side 116 and an end 118 of a drawer, lying in mutually perpendicular vertical planes extend towards respective adjacent ends where they are connected, by means of a bracket 110, in a corner construction. The bracket 110 is fitted to the members 116, 118, as shown in FIG. 10, by downward movement of the bracket 110 relative to the members 116, 118, with the bracket 110 being in the orientation shown, so that the respective end part of each of the members 116, 118 is pushed along the respective channel provided by the bracket, in the longitudinal direction of the bracket, the inner surfaces of the side walls of each channel engaging the flanks of the respective members 116, 118. Each wall 112 is provided, on its side presented towards the interior of the respective channel, with a longitudinally extending, rectangular section rib 120 disposed intermediate the respective base wall 114 and the free edge of the respective wall 112. Each of the members 116, 118 has, adjacent the end to be received in the bracket end, a vertical rectangular section groove 122 cut in each of the two major faces of the member 116 or 118, the spacing of each groove 122 from the adjoining vertical end face of the member 116 or 118 corresponding to the spacing of the ribs 120 in each channel from the bottom of the respective channel. Thus, when the bracket 110 is pushed over the end portion of the member 116 or 118 as described above, the ribs 120 of the channel receiving the end of the respective member 116 or 118 slide along the respective grooves 122 in the respective member 116 or 118 and thus, when the bracket has been fitted completely, prevent removal of the member 116 or 118 horizontally from the bracket 110 in the longitudinal direction of the respective member 116 or 118.

Each of the side members 116 and the end member 118 has, adjacent its lower edge, on the inner side of the member 116, 118 a horizontally longitudinally extending groove or rebate 124 which in the assembled drawer receives respective edge portions of a flat, rectangular board forming the drawer bottom. It will be appreciated from FIG. 14, which is a plan view of a rear corner of the drawer before the bracket 110 is fitted, that in the region of the corner, the bottom 126 projects beyond the end face 127 of the respective member 116 or 118.

The vertical length of the two base walls 114 of the bracket, as measured from the top of the bracket and the corresponding vertical length of the two side walls 112 which lie on the inside of the drawer when the latter is assembled corresponds substantially to the vertical distance between the upper edge of the member 116 or 118 and the upper edge of the groove 124 therein, and the ribs 112 stop slightly short of the level of the lower edges of the base walls 114. However, the side walls 112 which, in the assembled drawer, lie on the outside of the drawer, are extended downwardly below the last mentioned level so that their lower edges, in the assembled drawer, are substantially at the level of the lower edges of the members 116, 118. Each of the outer walls 112 of the bracket carries, adjacent its lower end, a tooth 130, in the form of a flat plate lying substantially in the plane of the base wall 114 of the respective channel directly above and separated therefrom, as shown in FIG. 11, by a horizontally extending slot 132 which in use receives the edge portion of the drawer bottom 126. Each tooth 130 thus provides an upwardly facing horizontal abutment face 134 for engagement with the underside of the drawer bottom 126. Each tooth 130 extends from the respective outer side wall 112 towards the plane of the other tooth, and at its free end is spaced slightly from the plane of the other tooth. On the underside of each tooth 130 extending downwardly from said free end towards the plane of the side wall 112 carrying the tooth, is a sloping ramp face 136, which is not only inclined to the vertical as shown in FIG. 11 but is also inclined at 45° relative to the planes of the side wall 112 as shown in FIG. 13.

Each tooth 130 has the general form of a barb and the bracket is made of resilient material such as resilient synthetic plastics so that when, during fitting of the bracket 110, the teeth 130 encounter respective edges of the drawer bottom 126, the teeth 130 are deflected by the drawer bottom to allow the bracket to be pushed downwardly still further to the position where the teeth 130 clear the drawer bottom 126 and spring back below the latter, thereby preventing subsequent upward removal of the bracket 110, the material of the outer side walls 112 and the brackets 110 bending resiliently to allow such deflection of the teeth 130 and subsequent spring back thereof.

It will be noted from FIGS. 10 and 12 that the top of the bracket 110 is provided by a horizontal web 140 which, besides extending over the upper ends of the channels, and thus between the side walls 112 and base walls 114 of each channel, also includes a gusset 142, with an arcuate outer edge, which extends across the upper end of the V-shaped groove defined between the adjacent base walls 114 on the outside of the drawer corner. The gusset 142 serves to stiffen the bracket against bending about a vertical axis. Similar gussets extending between the adjacent walls 114 may be provided at intermediate levels in the bracket, in a manner similar to that shown at 160 in FIG. 16 relating to a variant bracket yet to be described.

It will also be noted that the outer side wall 112 of each channel, (i.e. the side wall 112 which, in the assembled drawer lies on the outside of the latter) is interrupted by a respective slot 144 which extends completely across the wall 112 and partly across the respective base wall 114, the upper edges of the two slots 144 of the bracket 110 lying in a first horizontal plane and the lower edges of the two slots 144 lying in a second horizontal plane spaced below the first.

The slots 144 are intended to provide clearance for the drawer runners, (not shown) which engage in horizontal grooves (not shown) formed on the outer sides of the drawer side walls, and on which the drawer, when installed, slides, the runners passing through the respective slots 144 and thus also acting to prevent upward removal of the bracket from the drawer.

The reason for providing both of the outer side walls 112 of the bracket with slots 144 is that by making the bracket 110 symmetrical about a vertical plane through the vertex of the angle formed between the two channels which vertical plane is at 45° to the planes of the side walls of the two channels, identical brackets can be used at both the right hand and left hand sides of the drawer. Thus it is unnecessary to manufacture left handed and right handed brackets differing from each other.

Whilst brackets such as the bracket 110 may be utilised also to connect the front (not shown) of the drawer to the sides thereof, in the same manner as described for the back of the drawer, the front of the drawer is preferably secured to the sides using brackets such as described with reference to FIGS. 1 to 4, 5, 6 or 7 to 9 herein.

FIGS. 15 to 18 illustrate at 210 a variant of the bracket 110 in which the slots 132 are omitted and in which the two base walls 114 of the bracket extend continuously over the whole vertical length of the bracket, but over a vertical length from the lower end of the bracket, corresponding to the distance from the lower end of the bracket to the upper edges of the slots 32 in the bracket 110 in FIGS. 10 to 13 said base walls each extend from the respective outer side wall 112, over only part of the width of the respective base wall in the upper part of the bracket to meet a respective side wall 150 of a recess 152 provided at the bottom of the bracket, each side wall 150 extending from the base wall which it meets, parallel with the side walls 112 of the respective channel in the direction away from the free longitudinal edges of the respective channel, to meet the other wall 150 in a vertical corner edge 154 set back from the base walls 114 of both channels. Each wall 150, at its upper edge, meets a further horizontal web 160, similar to the web 140 and provided adjacent the upper end of the bracket. The recess 152 receives the corner 162 (see FIG. 14) of the drawer bottom 126 when the bracket is fitted, the underside of the respective part of the web 160 engaging the upper surface of the drawer bottom in the region of said corner 162.

The bracket of FIGS. 15 to 18 is held in place on the respective side member 116 and end member 118 in the assembled drawer simply by friction, in the manner now to be described.

As shown in FIGS. 17 and 18 each of the base walls 114 of the bracket 110 has, in the region of its upper end, on its face on the interior of the respective channel, three ribs 170 which extend vertically in the longitudinal direction of the respective channel from the upper, closed end of the respective channel to a position spaced somewhat below the upper end of the respective channel, the three ribs 170 being spaced apart transversely. The ribs 170 are of uniform triangular cross-section over their entire length except for a short portion at the lower end of each rib 120 where the latter is chamfered to provide a downwardly directed ramp face 172 sloping downwardly to meet the interior surface of the respective base wall 114.

When the bracket 210 is pushed downwardly over the respective members 116 and 118 during assembly of the drawer in the same way as described in relation to the bracket 110 of FIGS. 10 to 13, the raised edges or ridges of the ribs 170 in the respective channel frictionally engage the end of the member 116 or 118 received in the respective channel, towards the end of the downward movement of the bracket, such frictional engagment, after the bracket is fully fitted, preventing spontaneous loosening and lifting of the bracket 110 from the respective members 116, 118 during use of the drawer, due to vibration during opening and closing or the like. This mode of securing the bracket 210 is particularly effective where the members 116 and 118 are of chipboard, possibly with the major faces and longitudinal edges provided with a veneer or finishing layer but with the end faces, of course being exposed chipboard.

The bracket of FIGS. 7 and 8 may similarly be modified by omitting the serrations 36 on the ribs 32 and providing on the inner surface of the base 19, over the region extending between the end wall 34 and a position adjacent, but spaced from, this end wall, a plurality of ribs, for example three, of substantially the same form as the ribs 170, spaced apart transversely and extending parallel with the longitudinal direction of the channel, said shallow longitudinal channel formed along the base 19 on the interior of the bracket and having the side walls 50 being either omitted entirely in this variant or stopping short of the region over which the ribs corresponding to ribs 170 extend. Thus this variant of the bracket of FIGS. 7 and 8 is frictionally retained on the side member of the drawer in the same way as described above with reference to the bracket of FIGS. 15 to 18.

The drawer constructions described are particularly suitable for "knock-down" furniture constructions in which furniture is provided to a customer in the form of a kit comprising parts which can be assembled to form the finished article of furniture with the minimum of effort by the purchaser and in particular without the need for such operations as sawing or cutting.

I claim:

1. A drawer construction comprising a front member, a back member, two side members, a bottom and a plurality of brackets respectively interengaging adjacent members, wherein each of said brackets includes a pair of traversely spaced side walls, a base wall connecting said side walls and defining with said pair of side walls a channel open at one end and closed at the other end by an end wall and wherein said channels are each provided with a pair of interfacing longitudinal guide ribs extending along the interiors of the side walls of the channel and disposed intermediate the base wall and the free edge of their respective side wall, said channels further being provided with longitudinally extending locking rib sections, said guide ribs and locking ribs permitting insertion of an end of one of said members in said channel by relative linear movement parallel with the longitudinal extent of the channel but inhibiting relative linear movement parallel with the longitudinal extent of the channel but in the opposite direction for withdrawal of said member from said channel, all of said members having parallel major faces on opposite sides thereof and a plurality of said members having grooves in their opposite major faces disposed adjacent and parallel with their end faces and complementary with the guide ribs of the channel in which said end faces are received.

2. The drawer construction of claim 1 wherein the longitudinal ends of said guide ribs remote from the end walls of the channels in which they are provided are chamfered.

3. The drawer construction of claim 1 wherein said locking rib sections are provided with saw-tooth serrations acting as barbs to permit insertion but resist withdrawal of the respective drawer member.

4. The drawer construction of claim 3 wherein said locking rib sections are formed as an integral part of said guide ribs.

5. The drawer construction of claim 1 wherein said locking rib sections comprise a plurality of spaced apart ribs extending vertically along said base wall in the longitudinal direction of the respective channel from the upper closed end to a position spaced somewhat below the upper end of the channel, said ribs having chamfered lower ends to provide a downwardly directed ramp face sloping to meet the interior surface of said base wall, whereby the respective drawer members are gripped and retained frictionally as the bracket is pushed home on the drawer members.

6. The drawer construction of claim 1 wherein the interfacing longitudinal guide ribs of at least some of said brackets are offset with respect to each other.

7. The drawer construction of claim 1 wherein the interfacing longitudinal guide ribs of at least some of said brackets are of different lengths.

8. The drawer construction of claim 1 wherein the base wall of at least one of said brackets is provided with holes formed in the bottom of a shallow longitudinal channel formed along the interior surface thereof and fastening means are provided to pass through said base wall holes for securing the same to one of the major faces of one of said drawer members.

9. The drawer construction of claim 1 wherein the base wall of at least one of said brackets is provided with integral studs projecting from the exterior surface thereof in a direction opposite from that in which the side walls extend whereby said studs are adapted to be frictionally inserted in complementary bores provided in one of the major faces of one of said drawer members.

10. The drawer construction of claim 1 wherein at least one of said brackets includes two pairs of side walls, the side walls forming each of said pairs being parallel with each other, spaced apart transversely of each other and being perpendicular with the side walls of the other said pair, the bracket further including two base walls, each connecting the side walls of a respective said pair and defining therewith a respective said channel, the two channels having parallel directions of longitudinal extent, each of said channels receiving a respective one of two mutually perpendicular said members, said side walls of each said channels engaging opposite said major faces of the respective said member received thereby.

11. The drawer construction of claim 10 wherein longitudinal ribs are provided extending along the interiors of the walls of the two channels of the bracket and complementary grooves in the major faces of the mutually perpendicular drawer members received in said channels, said grooves in each said member being disposed adjacent and parallel with the end face of the respective drawer member, each said channel being open at one end of the bracket whereby, during assembly, the bracket is fitted over the adjacent ends of the mutually perpendicular drawer members by longitudinal movement of the bracket with said one open end leading in the direction of movement of the bracket.

12. The drawer construction of claim 11 wherein said mutually perpendicular drawer members connected by said bracket are provided with longitudinal grooves receiving edge portions of the drawer bottom, and the side walls of the bracket which lie on the outside of the drawer carry at said one end thereof, respective resilient teeth, acting as detents and engaging beneath the drawer bottom, to prevent vertical longitudinal movement of the bracket relative to the drawer members.

13. A kit including parts from which a drawer can be constructed, said kit including a drawer front, a drawer back, drawer sides and a plurality of brackets for respectively interengaging adjacent members, wherein each of said brackets includes a pair of traversely spaced side walls, a base wall connecting said side walls and defining with said pair of side walls a channel open at one end and closed at the other end by an end wall and wherein

14. A bracket for use in a drawer construction and comprising a first part for engagement with a first drawer member and a channel adapted to receive an end of a second drawer member extending perpendicular to the first drawer member, said channel being formed by a pair of traversely spaced side walls and a base wall connecting said side walls and defining with said pair of side walls a channel open at one end and closed at the other end by an end wall, said channel being provided with a pair of interfacing longitudinal guide ribs extending along the interiors of the side walls of the channel and disposed intermediate the base wall and the free edge of their respective side wall and said channel further being provided with longitudinally extending locking rib sections said guide ribs and locking ribs permitting insertion of an end of one of said members in said channel by relative linear movement parallel with the longitudinal extent of the channel but inhibiting relative linear movement parallel with the longitudinal extent of the channel but in the opposite direction for withdrawal of said member from said channel.

* * * * *